United States Patent [19]

Purr

[11] 4,379,467

[45] Apr. 12, 1983

[54] WASHING UNIT FOR AN OFFSET DUPLICATING MACHINE

[75] Inventor: Horst Purr, Tennenbronn, Fed. Rep. of Germany

[73] Assignee: Mathias Bauerle GmbH, Georgen, Fed. Rep. of Germany

[21] Appl. No.: 234,431

[22] Filed: Feb. 13, 1981

[30] Foreign Application Priority Data

Feb. 13, 1980 [DE] Fed. Rep. of Germany ..... 3005236

[51] Int. Cl.[3] ..... B08B 3/04

[52] U.S. Cl. ..... 134/111; 134/186

[58] Field of Search ..... 134/104, 109–111, 134/149, 155, 184, 186

[56] References Cited

U.S. PATENT DOCUMENTS

| | | | |
|---|---|---|---|
| 2,646,585 | 7/1953 | Whittington | 134/186 X |
| 2,860,785 | 11/1958 | Gardner | 134/111 X |
| 3,050,422 | 8/1962 | Zak | 134/111 X |
| 4,029,115 | 6/1977 | Wheeler | 134/111 |

FOREIGN PATENT DOCUMENTS

| | | | |
|---|---|---|---|
| 2828454 | 1/1979 | Fed. Rep. of Germany | 134/109 |
| 1123789 | 8/1968 | United Kingdom | 134/186 |

*Primary Examiner*—Robert L. Bleutge

*Attorney, Agent, or Firm*—Paul M. Craig, Jr.

[57] ABSTRACT

A washing unit for an offset duplicating machine, with the washing unit including a washing tank for accommodating a cleaning fluid and a washing roller arranged in the washing tank in such a manner so that at least a portion thereof is dipped in the cleaning fluid accommodated in the washing tank. The washing tank is connected to a circulatory system for recirculating the cleaning fluid. The circulatory system includes a pump for pumping the cleaning fluid through the circulatory system and a filter for filtering the cleaning fluid while the cleaning fluid is being recirculated in the circulatory system.

16 Claims, 1 Drawing Figure

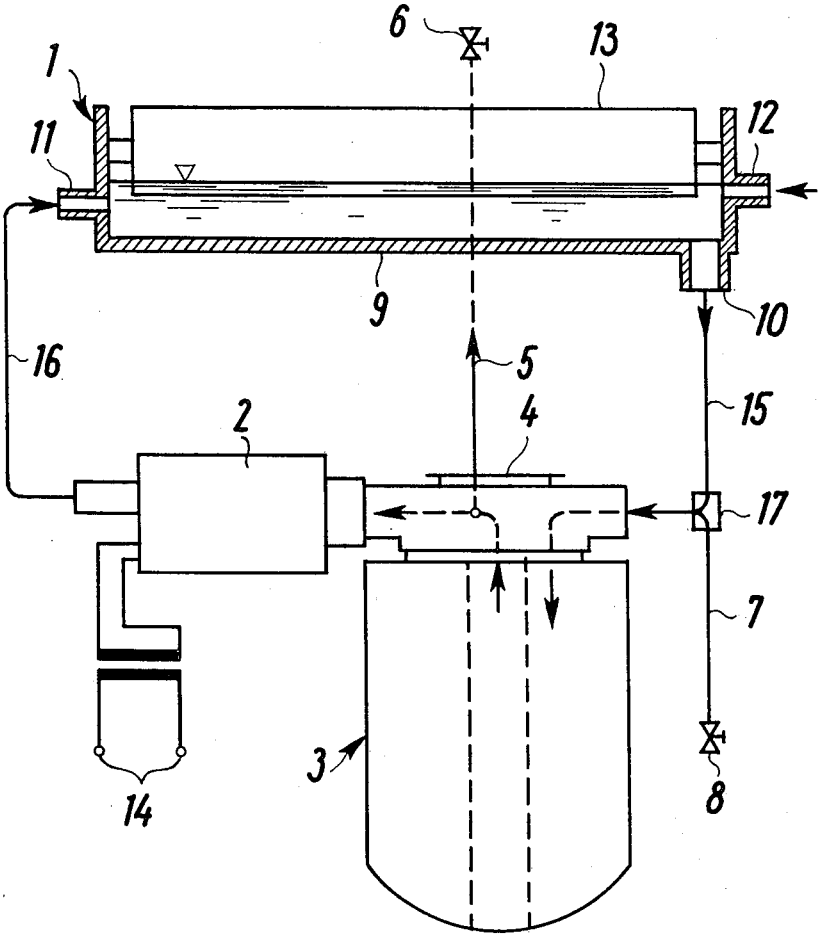
6
13
1
12
11
9
10
16
5
15
2
4
17
7
3
8
14

WASHING UNIT FOR AN OFFSET DUPLICATING MACHINE

The present invention relates to a washing unit and, more particularly, to a washing unit or installation for an offset duplicating machine which includes a washing tank and a washing roll, with the washing roll being adapted to dip into a cleaning fluid accommodated in the washing tank.

Generally, a washing unit for an offset duplicating machine includes a washing tank connected to a metering device which is adapted to feed a cleaning fluid to the washing tank and automatically maintain a specific fluid level. In proposed constructions, a washing roll dips into the cleaning fluid, with the roll being associated with a rubber blanket cylinder and serving to clean the rubber blanket cylinder.

A disadvantage of proposed washing units resides in the fact that, during practical operation, a relatively rapid contamination occurs in a washing unit since the residues removed from the rubber blanket cylinder lead to a sludge deposition in the washing tank. The contamination of the washing unit requires cleansing in order to render the washing unit useful again and, in many cases, the cleansing step, which represents a dirty and time consuming task must be carried out at least once a week.

In Offenlegungsschrift No. 2,538,067, an arrangement is proposed for preventing the sludge deposition in the washing tank which utilizes a cleaning cloth for cleaning the cylinder, with the cloth being unwound from a storage reel and re-wound onto another reel after cleaning. At the same time, a cleaning fluid is sprayed onto the cleaning cloth. The lengths of cloth required for carrying out the cleaning step and the amount of cleaning fluid required are dependent upon the degree of contamination. Once the cleaning cloth has been used up, a new reel with cleaning cloth is installed. A disadvantage of this proposed arrangement resides in the fact that the cleaning device requires a considerable number of structural components and is relatively expensive especially due to the large consumption of material. Moreover, this proposed cleaning device is greatly polluting and may not be installed in relatively small offset duplicating machines since the installation space necessary for accommodating the constructional dimensions of the proposed cleaning device is simply not available.

In Offenlegungsschrift No. 2,828,454, another cleaning device is proposed wherein a cleaning fluid is fed during a cleaning step to the washing tank by way of a pump with the fluid then being recycled into a storage tank. The purpose of recycling the fluid to a storage tank is so that the dissolved residues are precipitated in the storage tank so that sludge accumulates on the bottom of the storage tank rather than in the washing tank. A disadvantage of this proposed construction resides in the fact that, under practical operating conditions, even though no sludge deposition takes place in the washing tank, the entire cleaning fluid becomes contaminated after a short period of time to such a degree that only an inadequate cleaning effect is attained. Consequently, this proposed construction results in a large consumption of cleaning fluid which represents an environmental pollution of a considerable extent.

The aim underlying the present invention essentially resides in providing a washing unit for an offset duplicating machine which is constructed in such a manner that no sludge accumulations are produced in the washing tank while simultaneously maintaining the cleaning fluid in an uncontaminated state without the need of providing additional cleaning elements for the cylinder to be cleaned.

In accordance with advantageous features of the present invention, the washing tank is connected to a circulatory system which recirculates the cleaning fluid, with the circulatory system including a pump and a filter.

The provision of the supplemental device of the present invention, which circulates only the cleaning fluid fed to the washing tank, requires only a relatively small installation space so that it may be employed, in particular, even with relatively small offset duplicating machines. Moreover, with the construction of the present invention, the other devices such as, for example, the metering device for maintaining a certain level of the cleaning fluid is uneffected and a cleaning action is provided which is very efficient since the washing tank is always supplied with a purified cleaning fluid so that sludge deposition in the washing tank is prevented.

In accordance with further advantageous features of the present invention, the filter in the circulatory system is provided with an exchangeable filter insert. By virtue of the provision of a changeable filter insert, the necessary servicing operations are limited to a simple replacement of the filter which can be done in a simple and efficient manner without the operating personnel getting dirty in executing the servicing operations.

Advantageously, in accordance with the present invention, the circulatory system includes a venting device arranged downstream of the filter and connected at the highest-level location. In this connection, it is advantageous to provide the venting device with a transparent hose extending out of the offset duplicating machine. By virtue of the provisions of the transparent hose, operating personnel can readily observe the condition of the cleaning fluid from the hose, that is, whether the cleaning fluid itself is still sufficiently clear to carry out efficient cleaning action.

It is especially advantageous in accordance with the present invention, to arrange the venting device behind the filter and the pump which draws the cleaning fluid through the filter. While the pump is operating, the liquid level within the venting device drops in correspondence with the intake vacuum produced by the pump, which vacuum is dependent upon the condition of the filter. If the filter itself is not contaminated and is readily permeable, than the intake vacuum produced is relatively minor. Upon an increase in contamination of the filter, the filter becomes clogged so that there is an increased intake vacuum and thus an increased drop in the liquid level occurring in the venting device. The extent of the drop in the liquid level in the venting device is thus an indication of the condition of the filter.

It is also possible in accordance with the present invention, to provide indicia or markers at the venting device which serve to indicate to the operating personnel that the filter insert must be exchanged. As can readily be appreciated, this monitoring operation can also be executed with the aid of a measuring instrument which is then connected to a signalling device indicating the fact that the filter must be replaced. Advantageously, according to the present invention, a discharging means is arranged at a lowest point of the circulatory system and, preferably, as viewed in a normal flow direction, upstream of the filter.

To ensure proper drainage of the washing tank, according to the present invention, a bottom of the washing tank is slanted toward the drainage connection of the circulatory system.

Accordingly, it is an object of the present invention to provide a washing unit for an offset duplicating machine which avoids, by simple means, shortcomings and disadvantages encountered in the prior art.

Another object of the present invention resides in providing a washing unit for an offset duplicating machine which minimizes necessary servicing operations to ensure an efficient cleaning action.

Yet another object of the present invention resides in providing a washing unit for an offset duplicating machine which minimizes if not avoids the deposition of sludge in the washing tank.

A further object of the present invention resides in providing a washing unit for an offset duplicating machine which minimizes the amount of cleaning fluid consumed in carrying out the cleaning operation.

A still further object of the present invention resides in providing a washing unit for an offset duplicating machine which is simple in construction and therefore relatively inexpensive to manufacture.

These and other objects, features, and advantages of the present invention will become more apparent from the following description when taken in connection with the accompanying drawing which shows, for the purposes of illustration only, one embodiment in accordance with the present invention, and wherein:

The single FIGURE of the drawing is a partially schematic view of a washing unit for an offset duplicating machine constructed in accordance with the present invention.

Referring now to the single FIGURE of the drawing, according to this FIGURE, a washing roll 13 is arranged in a washing tank generally designated by the reference numeral 1, with a lower circumferential portion of the washing roll 13 being adapted to be dipped into a cleaning fluid accommodated in the washing tank 1. The cleaning fluid is fed to the washing tank 1 through a connecting nipple 12 from a metering means (not shown) of a conventional construction, with the metering means being equipped with elements which insure a predetermined level of cleaning fluid in the washing tank 1.

The washing tank 1 is provided with an inlet connection or nipple 11 and an outlet connection or nipple 10, with both of the connections 10, 11 being in communication with a circulatory system for recirculating the cleaning fluid fed by the metering device and subjecting the cleaning fluid to a cleaning action during the recirculation. A filter generally designated by the reference numeral 3 is connected to the outlet connection 10 by way of a conduit 15. The filter 3 is in communication with the inlet connection 11 through a conduit 16 and a pump 2 which operates at a low power. The pump 2 is preferably constructed as a centrifugal pump and is equipped with an electric motor supplied with a current by way of a main connection 14. During an operation of the offset machine, the cleaning fluid is constantly recirculated in the circulatory system.

The filter 3 is a commercially available filter with an exchangeable filter cartridge. For example, a special paper filter insert having a filter fineness of a maximum of 10 μm may be provided. The filter cartridge is readily exchangeably connected with a fixed filter head 4 by means of a threaded connection provided between the filter cartridge and the filter head.

The cleaning fluid is fed to the filter 3 through the circulatory system in such a manner that the cleaning fluid flows into the filter housing and passes from the filter housing into the substantially cylindrical filter insert from which the pump 2 takes in the cleaning fluid and conveys the same by way of the conduit 16 to the washing tank 1 through the inlet connection 11.

Advantageously, the filter 3, pumps 2, and conduits 15, 16 are arranged beneath the washing tank 1 so that the circulatory system is automatically vented during operation. For this purpose, a vent conduit 5 is provided at the end of which is disposed a venting valve 6 which may, for example, be constructed as a check valve for preventing an intake of air. The venting conduit 5 is suitably connected to the highest point of the pump filter unit, especially at the filter head 4 at a position between the filter 3 and the pump 2.

Advantageously, the venting conduit 5 may be made of a transparent material and may be extended out of the offset duplicating machine and be disposed at a readily visible location. When the pump 2 is turned off, the same liquid level is established in the venting conduit 5 as in the washing tank 1, so that the functioning of the metering device can be tested by an inspection of the liquid level in the venting conduit 5. For this purpose, indicia or other markings may be associated with the venting conduit 5 so as to facilitate the testing of the metering device.

When the pump 2 is turned on, the level of the cleaning fluid in the venting conduit 5 drops in correspondence with the intake vacuum of the pump 2. The intake vacuum of the pump 2 increases as the degree of contamination of the filter 3 increases so that the fluid level in the venting conduit 5 drops even further. By monitoring the level and drop in level of the venting conduit 5, it is possible to provide for an indication of the degree of contamination of the filter 3. For this purpose, it is possible to provide another marking or indicia on the venting conduit 5 which sets or fixes the lowest or deepest permissible liquid level of the cleaning fluid, with such indicia being utilized as an indication to an operating personnel of a necessity for changing the filter cartridge of the filter 3. As can readily be appreciated, an indication of the degree of contamination of the filter may also be effected automatically by means of suitable measuring elements (not shown).

The outlet or drainage connection 10 is arranged at the lowest point of a slanting bottom wall 9 of the washing tank 1. The drainage connection 10 is connected through the conduit 15 and a branch 17 to the filter 3. A further conduit 7, provided with a drainage valve 8, is connected to the branch 17. The washing tank 1 can be completely emptied through the conduit 7 upon an opening of the drainage valve 8.

If the pump 2 is turned on during an emptying of the washing tank 1 through the conduit 7, then the filter 3 may also be completely emptied at the same time thereby dispensing with the necessity of removing the filter 3. However, it is also possible to, for example, arrange the filter 3 so as to be pivotable thereby enabling the filter 3 to be emptied by a swinging or pivoting of the filter 3 into a suitable position.

While I have shown and described only one embodiment in accordance with the present invention, it is understood that the same is not limited thereto but is susceptible of numerous changes and modificationa as known to one having ordinary skill in the art, and I therefore do not wish to be limited to the details shown and described herein, but intend to cover all such modifications as are encompassed by the scope of the appended claims.

I claim:

1. A washing unit for an offset duplicating machine, the washing unit comprising a washing tank means for accommodating a cleaning fluid, a washing roll means arranged in the washing tank means so as to enable a portion thereof to be dipped into the cleaning fluid accommodated in the washing tank means, and feeding means for feeding cleaning fluid to the washing tank means, characterized in that a circulatory means independent of the feeding means is connected to the washing tank means for recirculating the cleaning fluid, the circulatory means includes a pump means for pumping the cleaning fluid through the circulatory means, and filter means for filtering the cleaning fluid as the cleaning fluid is recirculated in the circulatory means.

2. A washing unit according to claim 1, characterized in that the filter means includes an exchangeable filter insert.

3. A washing unit according to one of claims 1 or 2, characterized in that the circulatory means includes a venting means disposed at a position downstream of the filter means, as viewed in a flow direction of the cleaning fluid, and in that the venting means is arranged at a highest-level location of the circulatory means.

4. A washing unit according to claim 3, characterized in that the venting means includes a transparent member extending out of the offset duplicating machine for enabling a monitoring of a degree of contamination of the filter means.

5. A washing unit according to claim 4, characterized in that the transparent member is a hose.

6. A washing unit according to claim 5, characterized in that the venting means includes a venting valve means arranged at an end of the transparent member for automatically venting the circulatory means during operation thereof.

7. A washing unit according to claim 6, characterized in that the pump means is arranged so as to draw the cleaning fluid through the filter means, and in that the venting means is arranged at a position located between the filter means and the pump means.

8. A washing unit according to claim 7, characterized in that means are provided at a lowest point of the circulatory means for enabling a discharging of the cleaning fluid from the circulatory means.

9. A washing unit according to claim 8, characterized in that the discharging means is arranged at a position upstream of the filter means as viewed in a flow direction of the cleaning fluid.

10. A washing unit according to claim 9, characterized in that the washing tank means includes a bottom wall and a drainage connecting means for connecting the washing tank means with the circulatory means, and in that the bottom wall of the washing tank means slants in a direction toward the drainage connecting means.

11. A washing unit according to claim 1, characterized in that the pump means is arranged so as to draw the cleaning fluid through the filter means, and in that a venting means is arranged between the filter means and pump means for automatically venting the circulatory means during operation thereof.

12. A washing unit according to claim 11, characterized in that means are provided at a lowest point of the circulatory means for enabling a discharging of the cleaning fluid from the circulatory means.

13. A washing unit according to claim 12, characterized in that the washing tank means includes a bottom wall and a drainage connecting means for connecting the washing tank means with the circulatory means, and in that the bottom wall of the washing tank means slants in a direction toward the drainage connecting means.

14. A washing unit according to claim 1, characterized in that means are provided at a lowest point of the circulatory means for enabling a discharging of the cleaning fluid from the circulatory means.

15. A washing unit according to claim 14, characterized in that the discharging means is arranged at a position upstream of the filter means as viewed in a flow direction of the cleaning fluid.

16. A washing unit according to claim 15, characterized in that the washing tank means includes a bottom wall and a drainage connecting means for connecting the washing tank means with the circulatory means, and in that the bottom wall of the washing tank means slants in a direction toward the drainage connecting means.

* * * * *